US012329280B2

(12) United States Patent
Li

(10) Patent No.: US 12,329,280 B2
(45) Date of Patent: Jun. 17, 2025

(54) STORAGE SHELVING DEVICE AND BRACKET COMPONENT

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 114 days.

(21) Appl. No.: 17/295,448

(22) PCT Filed: Mar. 19, 2021

(86) PCT No.: PCT/CN2021/081799
§ 371 (c)(1),
(2) Date: Oct. 3, 2023

(87) PCT Pub. No.: WO2022/165935
PCT Pub. Date: Aug. 11, 2022

(65) Prior Publication Data

US 2024/0016290 A1 Jan. 18, 2024

(30) Foreign Application Priority Data

Feb. 5, 2021 (CN) ..... 202110158366.1

(51) Int. Cl.
*A47B 96/06* (2006.01)
*A47B 57/42* (2006.01)

(52) U.S. Cl.
CPC ..... *A47B 96/061* (2013.01); *A47B 57/42* (2013.01)

(58) Field of Classification Search
CPC ..... A47B 96/061; A47B 57/42
USPC ..... 248/235
See application file for complete search history.

(56) References Cited

U.S. PATENT DOCUMENTS 2,576,865 A * 11/1951 Charles ..... A47B 57/408 248/222.13
5,116,007 A * 5/1992 Von Gunton ..... A47B 57/42 108/108
10,098,460 B1 * 10/2018 Brinton, Jr. ..... A47B 96/145
11,864,655 B2 * 1/2024 Li ..... A47B 96/061
(Continued)

FOREIGN PATENT DOCUMENTS

CN 201782337 A 4/2011
CN 208524133 X 2/2019
(Continued)

OTHER PUBLICATIONS

International Search Report of PCT/CN2021/081799.

*Primary Examiner* — Anita M King

(57) ABSTRACT

The present disclosure provides a storage shelving device and a bracket component. The storage shelving device includes a storage shelving member, a bracket and a limiting member. The bracket is detachably disposed in a preset mounting position, and the limiting member mounted on the bracket matches with the storage shelving member and is configured to prevent the storage shelving member from separating from the bracket. The storage shelving member does not easily separate from the bracket due to a limiting member in the storage shelving device, thus avoiding a safety hazard.

15 Claims, 7 Drawing Sheets

(56) References Cited

U.S. PATENT DOCUMENTS

| | | | | |
|---|---|---|---|---|
| 2019/0059587 | A1 | 2/2019 | Brinton, Jr. | |
| 2025/0000254 | A1* | 1/2025 | Li | A47B 96/06 |

FOREIGN PATENT DOCUMENTS

| | | | |
|---|---|---|---|
| CN | 210643231 | X | 6/2020 |
| CN | 211154632 | A | 8/2020 |

* cited by examiner

STORAGE SHELVING DEVICE AND BRACKET COMPONENT

CROSS-REFERENCE TO RELATED APPLICATIONS

This application is a National Stage application of International application No. PCT/CN2021/081799, filed on Mar. 19, 2021, which claims all benefits of the priority from China Patent Application No. 202110158366.1, filed on Feb. 5, 2021, titled "STORAGE SHELVING DEVICE AND BRACKET COMPONENT" in the China National Intellectual Property Administration, the content of which is hereby incorporated by reference.

TECHNICAL FIELD

The present disclosure generally relates to the technical field of the placement and display of objects, and in particular, to a storage shelving device and a bracket component.

BACKGROUND

Detachable storage shelving devices have been widely used in homes and workplaces. The storage shelving device usually includes a storage shelving member and a bracket component configured to mount the storage shelving member, and the storage shelving member can be detachably mounted on the bracket component. A conventional storage shelving member is usually directly connected to the bracket component of the storage shelving device, and the storage shelving member may easily separate from the bracket component when used or disassembled, thus leading to a safety hazard.

SUMMARY

According to various embodiments of the present disclosure, an improved storage shelving device and a bracket component are provided. The storage shelving device includes a storage shelving member, a bracket and a limiting member. The bracket is detachably disposed in a preset mounting position, and the limiting member mounted on the bracket matches with the storage shelving member and is configured to prevent the storage shelving member from separating from the bracket.

The above storage shelving device has the following advantages:

The storage shelving member does not easily separate from the bracket due to a limiting member in the storage shelving device, thus avoiding a safety hazard.

In some embodiments, the bracket comprises a cantilever portion configured to support the storage shelving member and disposed in the preset mounting position.

In some embodiments, the storage shelving device further includes a support member. The preset mounting position is located on the support member. The limiting member is rotatably connected to the cantilever portion and able to buckle at least a part of the storage shelving member to the cantilever portion and abut against the support member during rotation.

In some embodiments, the support member is provided with a concave portion configured to clamp the bracket, and the limiting member includes a clamping portion which protrudes towards the support member and is able to be clamped into the concave portion.

In some embodiments, a first gasket is provided between the cantilever portion and the limiting member, and the first gasket and the cantilever portion are fixed with each other.

In some embodiments, the limiting member is clamped to the cantilever portion.

In some embodiments, a second gasket is fixedly connected between the cantilever portion and the limiting member, and the second gasket is provided with a first groove. The limiting member extends towards the second gasket and forms a bulge, and the bulge extends to the first groove to match with each other resulting in the limiting member being clamped to the second gasket.

In some embodiments, the limiting member is fixedly connected to the cantilever portion.

In some embodiments, the limiting member includes two gasket portions disposed opposite to each other and a connecting portion between the two gasket portions, and the limiting member is fixed with the cantilever portion by the two gasket portions.

In some embodiments, the gasket portions are fixed to the cantilever portion.

In some embodiments, a part of the connecting portion folds towards the storage shelving member and forms a limiting portion, a third groove is formed between the limiting portion and the connecting portion, and at least a part of the storage shelving member is accommodated in the third groove to prevent the storage shelving member from separating from the bracket.

In some embodiments, the bracket is provided with a second groove, an opening of the second groove is provided with a hook portion, and the hook portion is located on a path of overturning of the storage shelving member around the limiting portion, resulting in preventing the storage shelving member from overturning.

In some embodiments, the second groove is disposed at one end of the bracket far away from the preset mounting position.

In some embodiments, the bracket is fixed in the preset mounting position by a fastening member.

In some embodiments, the bracket further includes a bracket connecting portion, and the bracket connecting portion is disposed on the cantilever portion and fixed in the preset mounting position by the fastening member.

An embodiment of the present disclosure also provides a bracket component configured to support a storage shelving member. The bracket component includes a bracket and a limiting member, the bracket is detachably disposed in a preset mounting position, and the limiting member mounted on the bracket matches with the storage shelving member and is configured to prevent the storage shelving member from separating from the bracket.

In some embodiments, the bracket includes a cantilever portion.

In some embodiments, the bracket component further includes a support member provided with a concave portion, and the bracket is mounted on the support member by the concave portion. The limiting member includes a rotating shaft and a clamping portion connected with each other, the limiting member is rotatably connected to the cantilever portion by the rotating shaft, and the clamping portion extends into and is clamped to the concave portion to limit a rotation of the limiting portion.

In some embodiments, the clamping portion includes a convex rib, which extends into and is clamped to the concave portion.

In some embodiments, the limiting member further includes an elastic connecting portion between the rotating shaft and the clamping portion, and the elastic connecting portion is configured to connect the rotating shaft and the clamping portion and provide an elastic force and an activity space for the clamping portion.

In some embodiments, the clamping portion extends away from the support member and forms a first pressing portion, the first pressing portion is configured to drive the clamping portion to move away from the concave portion and release the clamping between the clamping portion and the support member.

In some embodiments, the limiting member includes two buckling portions disposed opposite to each other and a conjunction portion between the two buckling portions and configured to connect the two buckling portions, and the two buckling portions are respectively buckled to the cantilever portion.

In some embodiments, the conjunction portion is provided with a limiting plate, the limiting plate bends towards the storage shelving member and forms a third groove, and at least a part of the storage shelving member is accommodated in the third groove.

In some embodiments, the limiting member includes two gasket portions disposed opposite to each other and a connecting portion between the two gasket portions and configured to connect the two gasket portions, and the two gasket portions are respectively fixed to the cantilever portion.

In some embodiments, a part of the connecting portion folds towards the storage shelving member and forms a limiting portion, a fourth groove is formed between the limiting portion and the connecting portion, and at least a part of the storage shelving member is accommodated in the fourth groove.

In some embodiments, the limiting portion is provided with a second pressing portion, and the second pressing portion folds away from the fourth groove and is configured to drive the limiting portion to release clamping between the limiting portion and the storage shelving member.

BRIEF DESCRIPTION OF THE DRAWINGS

One or more drawings are referred to describe and illustrate embodiments and/or examples of the present disclosure disclosed here. The additional details or examples used to describe the drawings should not be considered to limit the scope of the present disclosure, the embodiments and/or examples currently described, and any of the best models currently understood for the present disclosure.

REFERENCE SIGNS

Figure 1:
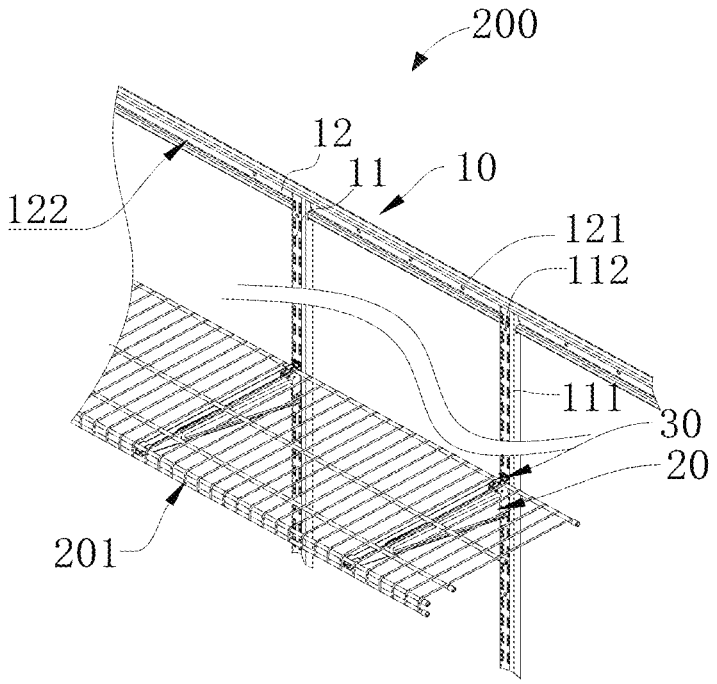
FIG. 1 is a schematic diagram of a local structure of a storage shelving device in an embodiment of the present disclosure.

In the drawing, 200 represents a storage shelving device, 100 represents a bracket component, 10 represents a support member, 11 represents a first support member, 111 represents a concave portion, 112 represents a first connecting hole, 12 represents a second support member, 121 represents a second connecting hole, 122 represents a slideway, 20 or 20*a* represents a bracket, 21 represents a cantilever portion, 211 represents a support plate, 212 represents a shaft hole, 22 represents a mounting portion, 221 represents a mounting plate, 222 or 222' represents a connecting groove, 23 represents a first accommodating groove, 24 represents a bracket connecting portion, 241 represents a mounting hole, 25 represents a second groove, 251 represents a hook portion, 30 represents a limiting member, 31 represents a body, 32 represents a rotating shaft, 33 represents a second accommodating groove, 34 represents a clamping portion; 341 represents a convex rib, 35 represents an elastic connecting portion, 36 represents a first pressing portion, 40 represents a first gasket, 30*a* represents a limiting member, 31*a* represents a buckling portion, 31*la* represents a bulge, 32*a* represents a conjunction portion, 33*a* represents a limiting plate, 34*a* represents a third groove, 40*a* represents a second gasket, 41*a* represents a first groove, 30*b* represents a limiting member, 31*b* represents a gasket portion, 311*b* represents a mounting groove, 312*b* represents a first hole, 32*b* represents a connecting portion, 33*b* represents a limiting portion, 34*b* represents a fourth groove, 35*b* represents a second pressing portion, 201 or 201*b* represents a storage shelving member, 2011 represents an assembly portion.

The above main element label description combines with the drawings and detailed description of the embodiments for further detailed illustration of the present disclosure.

DETAILED DESCRIPTION OF THE EMBODIMENT

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when a component is considered to be "mounted on" another component, it can be directly on another component or there can be a centered component. When a component is considered to be "disposed on" another component, it can be disposed directly on another component or there may be a centered component at the same time. When a component is considered to be "fixed to" another component, it can be directly fixed to another component, or there may be a centered component. The terms "vertical", "horizontal", "left", "right" and similar expressions used herein are for illustrative purposes only and are not meant to be the only means of implementation.

Unless otherwise defined, all technical and scientific terms used herein have the same meaning as a skilled person in the art would understand. The terminology used in the description of the present disclosure is for the purpose of describing particular embodiments and is not intended to limit the present disclosure. The term "or/and" as used herein includes any and all combinations of one or more related listed items.

Figure 2:
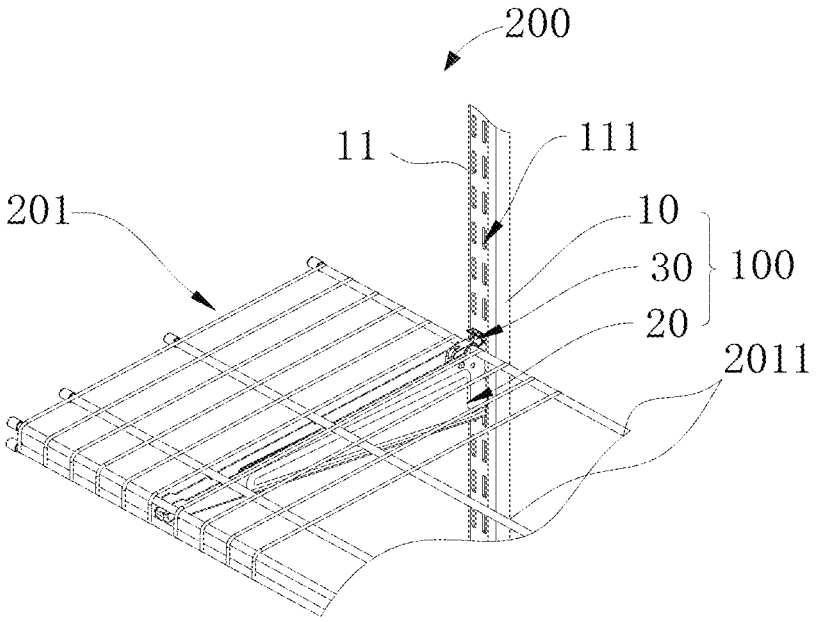
FIG. 2 is a partial enlargement diagram of the storage shelving device of FIG. 1.
Figure 3:
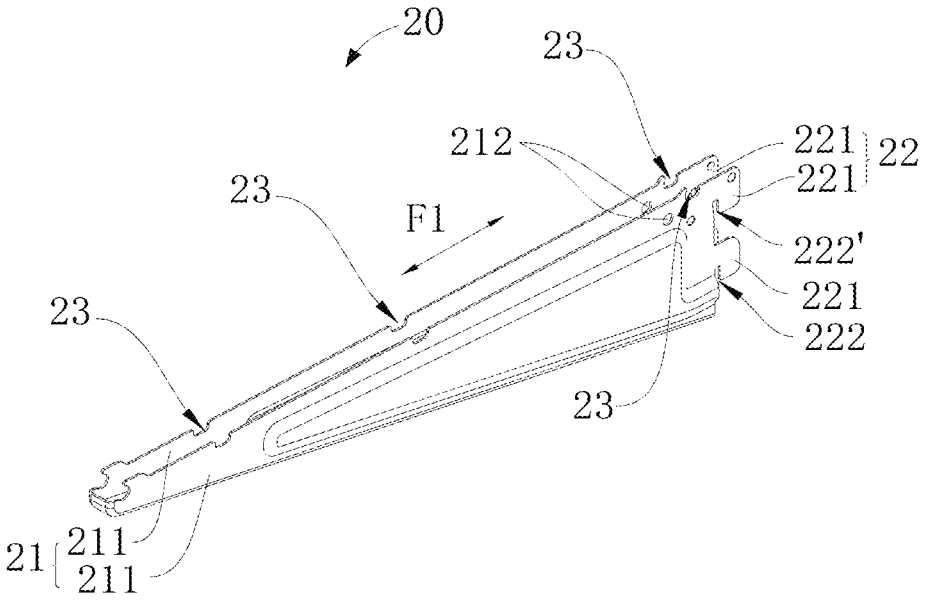
FIG. 3 is a schematic diagram of a bracket in the storage shelving device of FIG. 1.

FIG. 1 is a schematic diagram of a local structure of a storage shelving device 200 in an embodiment of the present disclosure, FIG. 2 is a partial enlargement diagram of the storage shelving device 200 of FIG. 1, and FIG. 3 is a schematic diagram of a bracket 20 in the storage shelving device 200 of FIG. 1.

In an embodiment of the present disclosure, a storage shelving device 200 is provided and configured to place objects, specially place and store objects at home, or place, store and display goods in shopping mall, etc.

The storage shelving device 200 includes a bracket component 100 and a storage shelving member 201. The bracket component 100 is configured to support the storage shelving member 201. The storage shelving member 201 can be a grid structure which is welded by steel wire, and the storage shelving member 201 is configured to support objects.

In this embodiment, the bracket component 100 includes a support member 10 and a bracket 20. The bracket 20 is detachably connected to the support member 10. The support member 10 can be directly or indirectly placed on the ground or mounted vertically on a wall, etc. A plurality of preset mounting positions configured for mounting the bracket and with different heights are disposed on the support member 10, so that the bracket can be mounted on the support member 10 and with different heights, and the bracket can be connected to the support member 10 and support the storage shelving member 201. When the bracket 20 is directly mounted on the wall, etc., the bracket component 100 may not include the support member 10.

As shown in FIG. 1, the support member 10 includes a first support member 11. The first support member 11 is mounted along a vertical direction. The first support member 11 is configured to connect and support the bracket 20, and to erect the bracket 20 on the ground or fix the bracket 20 to the wall in the vertical direction.

As shown in FIG. 1 and FIG. 2, in order to mount the bracket 20 at the different positions with different heights of the support member 10, a plurality of concave portions 111 are provided at the different positions with different heights of the first support 11. The concave portions 111 are configured to connect the bracket 20 to the support member 10, so that the bracket 20 can be detachably mounted at the different heights of the first support member 11, thus the placement height of the storage shelving member 201 can be adjusted accordingly. Optionally, the concave portions 111 at each height are disposed in pairs.

Furthermore, as shown in FIG. 1 and FIG. 2, the first support member 11 is provided with a first connecting hole 112 configured to fix to the wall. A number of the first connecting holes 112 can be selected as multiple. Multiple first connecting holes 112 are arranged along a length direction of the first support member 11, and each first connecting hole 112 is configured for one-to-one disposing corresponding to a fastening member. In this way, the first support member 11 can be stably fixed to the wall by a plurality of fastening members.

Optionally, the support member 10 can also include a second support member 12. The connection between the first support member 11 and the second support member 12 is disclosed in the U.S. patent Ser. No. 07/543,731 and U.S. Ser. No. 09/436,363. The first support member 11 is able to slide relative to the second support member 12.

Specifically, the second support member 12 is horizontally connected to the wall and a surface of the second support member 12 facing to the first support member 11 is sunk to form a slideway 122. In the case of multiple first supports members 11, the disposing of the second support member 12 facilitates a spacing adjustment among multiple first support members 11, so that the support member 10 is suitable for the storage shelving members 201 with different sizes. The slideway 122 of the second support member 12 is configured to accommodate a part of the first support member 11 and allow the first support member 11 to slide along a length direction of the second support member 12, resulting in avoiding the first support member 11 being mounted inclined. During the mounting, the first support member 11 slides to a mounting position of the second support member 12, the second support member 12 is connected to the wall by the fastening members, and the first support 11 is connected to the wall by the fastening members.

In most cases, the first support member 11 only has a certain tension with the wall by the fastening members. In the case of a loosening between the fastening members of the first support member 11 and the wall, an inner wall of the slideway 122 of the second support member 12 can bear a part of the tension of the first support member 11.

As shown in FIG. 1, the second support member 12 is provided with a plurality of second connecting holes 121. The second connecting holes 121 are matched with the fastening members (not shown in the figure) to fix the second support member 12 to a preset mounting position of the wall. Alternatively, when the second support member 12 does not need to be fixed to the wall, the second connecting holes 121 of the second support member 12 may be omitted accordingly.

Alternatively, a plurality of the second connection holes 121 are uniformly arranged along the length direction of the second support member 12. In this way, the second support member 12 and the wall can be uniformly stressed by the fastening members.

As shown in FIG. 1, a number of the brackets 20 is multiple. In the embodiment shown in FIG. 3, each bracket 20 includes a cantilever portion 21 and a mounting portion 22 disposed at one end of the cantilever portion 21. The cantilever portion 21 is configured to support the storage shelving member 201 and includes two support plates 211 and a connecting plate (unlabeled) configured to connect the two support plates 211. The two support plates 211 are roughly triangular-shape sheet structure, and a section formed by the two support plates 211 and the connecting plate can approximately be in a "U" shape. The two support plates 211 are separated and fixed by the connecting plate. Specifically, the connecting plate is connected to the side of the two support plate 211 away from the storage shelving member 201. The cantilever portion 21 includes two sheet-like support plates 211 and the connecting plate, resulting in reducing a material consumption and weight while ensuring a structural strength. It can be understood that, according to different use scenes and requirements, in other embodiments, each cantilever portion 21 can be provided with only one support plate 211, or three or more support plates 211, without limitation here.

The mounting portion 22 extends away from the cantilever portion 21 to connect the cantilever portion 21 to the support member 10. In this embodiment, the mounting portion 22 is connected to the support plate 211 correspondingly. The mounting portion 22 includes two mounting plates 221, which are approximately square-shaped sheet structure. The two mounting plates 221 are configured to extend into the concave portions 111 at the same height, respectively. It is understood that a number of the mounting plates 221 can be changed according to a number of the support plates 211.

Alternatively, two mounting plates 221 are provided at different heights of each support plate 211. The support plate 211 extends into the concave portions 111 at different heights by the two mounting pieces 221 to strengthen connection strength between the bracket 20 and the support member 10.

In an embodiment, a connecting groove 222 (or 222') is disposed between the mounting plate 221 and a corresponding support plate 211. When the mounting plate 221 extends into the concave portion 111, the mounting plate 221 can fall along a length direction of the concave portion 111 due to the disposing of the connecting groove 222 (or 222'). At this time, the mounting plate 221 can form a clamping connection with the support member 10 by the concave portion 111, resulting in preventing the bracket 20 from pulling out from the concave portion 111 of the support member 10.

As shown in FIG. 2 and FIG. 3, the bracket 20 is provided with a plurality of first accommodating grooves 23. Specifically, the first accommodating grooves 23 are disposed on a side of the support plate 211 towards the storage shelving member 201. Correspondingly, the storage shelving member 201 includes an assembly portion 2011 capable of extending into the first accommodating groove 23. A plurality of assembly portions 2011 are disposed on the storage shelving member 201. The first accommodating grooves 23 are configured to prevent collision with the assembly portions 2011 at a corresponding position and for facilitating the assembly portion 2011 of the storage shelving member 201 to extend into. The assembly portion 2011 is configured to match with the first accommodating grooves 23 and prevent the storage shelving member 201 from separating from the bracket 20 along a first direction F1 as shown in FIG. 3. The number and position of the first accommodating grooves 23 are disposed according to the assembly portions 2011 of the storage shelving member 201. Wherein, the first direction F1 is parallel to an extension direction of a side of the bracket 20 used to support the storage shelving member 201. It can be understood that the assembly portion 2011 can be a rod-shaped structure or a bulge structure disposed on the storage shelving member 201, as long as the assembly portion 2011 can be matched with the first accommodating groove 23.

Figure 4:
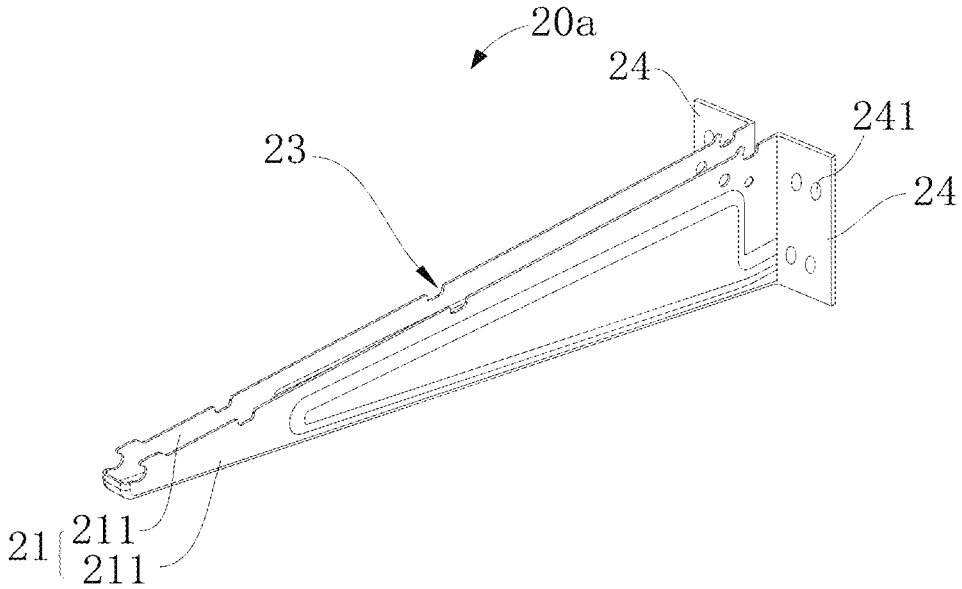
FIG. 4 is a schematic diagram of a bracket in another embodiment of the present disclosure.

FIG. 4 is a schematic diagram of a bracket 20*a* in another embodiment of the present disclosure.

The structure of the bracket 20*a* is shown in FIG. 4. In this embodiment, the bracket 20*a* can be disposed and fixed in the preset mounting position of the wall or the support member 10. When the bracket 20*a* is directly disposed on the wall, the storage shelving device 200 may not include the support member 10.

Compared with bracket 20 in the embodiment as shown in FIG. 1 to FIG. 3, the bracket 20*a* as shown in FIG. 4 further includes a bracket connecting portion 24 connected with the cantilever portion 21. The bracket 20*a* is fixed to the support member 10 or the wall by the bracket connecting portion 24. The bracket connecting portion 24 is disposed on a side of the cantilever portion 21 close to the support member 10 or the wall and configured to connect with the support portion 10 or the wall. Alternatively, the bracket connecting portion 24 can approximately be a square-shaped sheet structure, bent relative to the cantilever portion 21 and fit to the support member 10 or the wall. The bracket connecting portion 24 is provided with a mounting hole 241. The mounting hole 241 is configured for facilitating the fastening member to pierce and fix the bracket 20*a* to the support member 10 or the wall.

Furthermore, corresponding to a number of the support plates 211, a number of bracket connecting portions 24 can be two. Two bracket connecting portion 24 are respectively connected to the corresponding support plates 211. The two bracket connecting portions 24 extend in opposite directions. More specifically, an extending direction of the bracket connecting portion 24 is approximately vertical to the support plates 211.

A conventional storage shelving device may prevent the storage shelving member from separating from the bracket component along the first direction F1 only by the first accommodating groove. During use or disassembly the storage shelving member may still separate from the bracket component along other directions. For example, when objects are taken or placed, the storage shelving member with meshes is easy to be hooked by the objects, resulting in the assembly portion 2011 separating from the first accommodating groove, leading to a safety hazard.

In order to avoid the occurrence of the above problems, in the optional embodiment of the present disclosure, the bracket component 100 further includes a limiting member. The limiting member can further prevent the storage shelving member 201 from separating from the bracket 20 (or 20*a*), resulting in preventing the storage shelving member 201 from falling off during use. The limiting member is disposed on the bracket 20 (20*a*) and is matched with the storage shelving member 201 to prevent the storage shelving member 201 from separating from the bracket 20 (or 20*a*).

The specific implementation of the limiting member is illustrated by the following three embodiments.

First Embodiment

Figure 5:
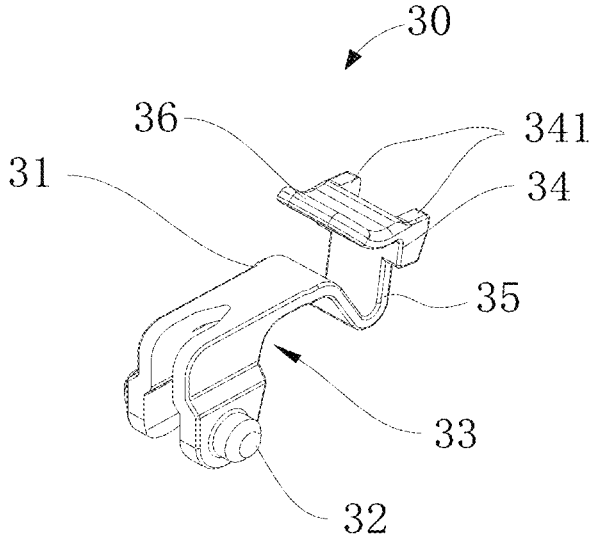
FIG. 5 is a schematic diagram of a limiting member in a first embodiment of the present disclosure.
Figure 6:
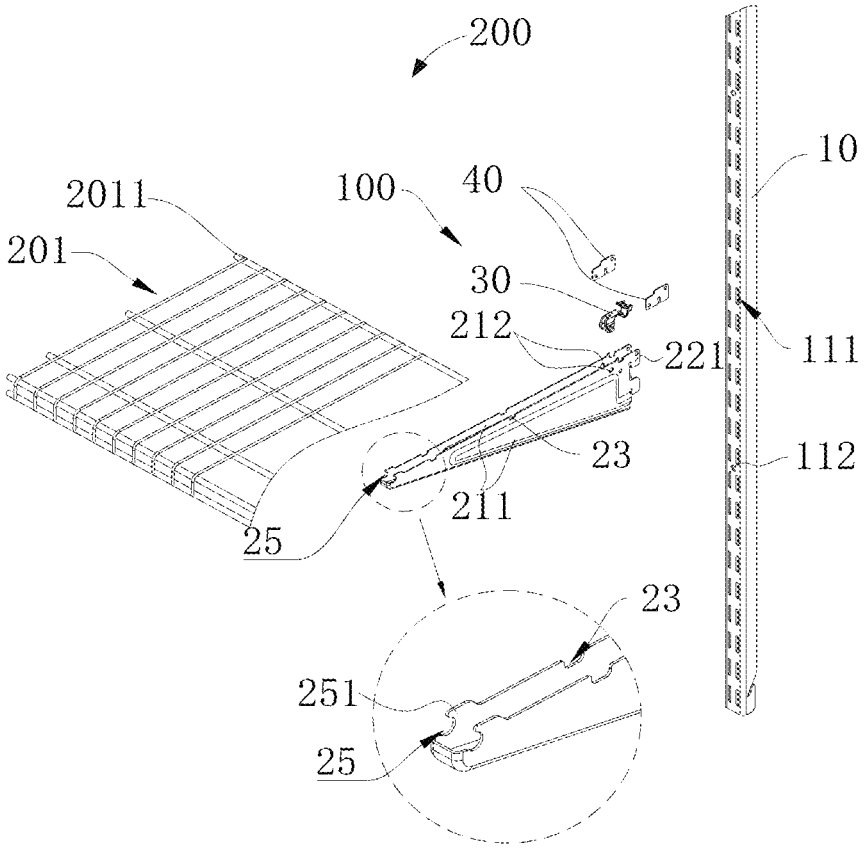
FIG. 6 is a disassembly diagram of a storage shelving device with the limiting member of FIG. 5.
Figure 7:
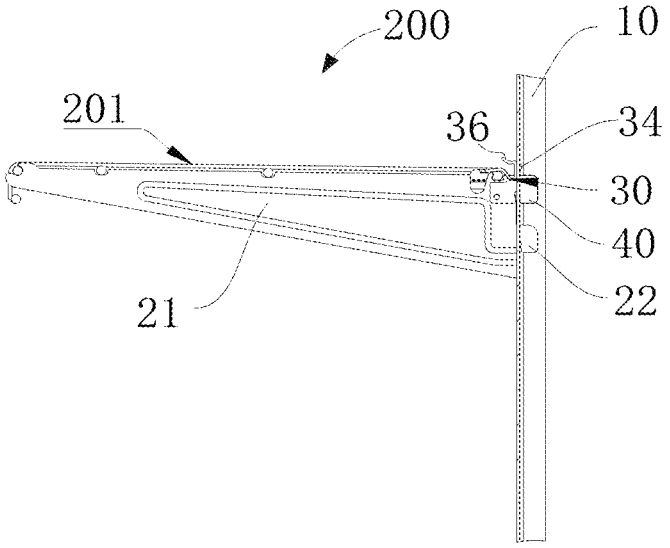
FIG. 7 is a schematic diagram of the storage shelving device of FIG. 6 in another view after assembly.

FIG. 5 is a schematic diagram of a limiting member 30 in a first embodiment of the present disclosure. FIG. 6 is a disassembly diagram of a storage shelving device 200 with the limiting member 30 of FIG. 5. FIG. 7 is a schematic diagram of the storage shelving device 200 of FIG. 6 in another view after assembly.

The limiting member 30 is rotatably connected to one end of the bracket 20 near the support member 10. Specifically, as shown in FIG. 5, the limiting member 30 includes a body 31 and a rotating shaft 32 connected to both sides of the body 31. The rotating shafts 32 on both sides protrude towards the support plates 211 respectively. The rotating shaft 32 is configured to rotate and dispose the body 31 to the cantilever portion 21. Correspondingly, the support plate 211 is provided with a shaft hole 212 at a position close to the support member 10. The rotating shaft 32 is mounted in the shaft hole 212 correspondingly. The rotating shaft 32 can drive the body 31 to rotate relative to the bracket and can limit the position of the storage shelving member 201 accordingly.

As shown in FIG. 5 and FIG. 6, the body 31 bends itself and forms a second accommodating groove 33. The second accommodating groove 33 is configured to form an enveloping space together with the corresponding first accommodating groove 23 close to the support member 10, so that the assembly portion 2011 of the storage shelving member 201 can be accommodated in the enveloping space. In this embodiment, as shown in FIG. 4 and FIG. 5, when the assembly portion 2011 of the storage shelving member 201 is accommodated into the first accommodating groove 23, the body 31 of the limiting member 30 rotates around the rotating shaft 32, resulting in an opening of the second accommodating groove 33 moving towards the assembly portion 2011. When the second accommodating groove 33 rotates to the top of the assembly portion 2011, the enveloping space for the assembly portion 2011 is formed between the second accommodating groove 33 and the corresponding first accommodating groove 23.

As shown in FIG. 5 and FIG. 7, the limiting member 30 further includes a clamping portion 34. The clamping portion 34 is connected to a side of the body 31 close to the support member 10. The clamping portion 34 is configured to clamp the limiting member to the support member 10, restricting a rotation of the body 31. When the limiting member 30 is clamped to the support member 10 by the clamping portion 34, a size of the enveloping space formed by the first accommodating groove 23 and the second accommodating groove 33 can be relatively determined, so that the assembly portion 2011 is relatively fixed in the enveloping space, or at least the assembly portion 2011 is not too loose relative to the bracket 20.

Alternatively, when the limiting member 30 is clamped to the support member 10 by the clamping portion 34, the size of the enveloping space formed by the first accommodating groove 23 and the second accommodating groove 33 is adapted to the size of the assembly portion 2011 of the storage shelving member 201. The limiting member can press the assembly portion 2011 of the storage shelving member 201 to the bracket by an inner wall of the second accommodating groove 33. At this time, the limiting member 30 can not only prevent the assembly portion 2011 from turning over and separating from the bracket 20, but also prevent the assembly portion 2011 from sliding along an axial direction of the assembly portion 2011, thus reducing the shaking of the storage shelving member 201 relative to the bracket 20. In addition, the limiting member can also improve a binding strength between the bracket 20 and the support member 10 and increase a bearing capacity of the bracket 20 accordingly by a connection between the clamping portion 34 and the support member 10.

The clamping portion 34 includes a convex rib 341 extending towards the support member 10. The convex rib 341 can extend into the corresponding concave portion 111 and resiliently abut against the concave portion 111. The convex rib 341 is matched with the concave portion 111 at the corresponding height. In this way, the clamping portion 34 is clamped and connected with the support member 10 by the convex rib 341, the mounting is simple and time-saving, and the limiting member 30 is not easy to loose. In addition, because the limiting member 30 is located between the bracket 20 and the support member a force between the clamping portion 34 and the support member 10 can reduce a connection gap between the mounting portion 22 and the support member 10, and the clamping portion 34 resiliently abuts against the support member 10 by the convex rib 341, so as to improve a connection stability between the bracket 20 and the support member 10.

In addition, because the convex rib 341 resiliently abuts against the concave portion 111, it can also prevent the bracket 20 from separating from the support member 10. As shown in FIG. 3, FIG. 5 and FIG. 6, in the case of the limiting member 30, the bracket 20 and the support member 10 being assembled in the storage shelving device 200, the convex rib 341 of the clamping portion 34 is corresponding on the top of the mounting plate 221 and clamped into the same concave portion 111 as the mounting plate 221. A distance between an upper edge of the mounting plate 221 and an upper edge of the connecting groove 222' is denoted by H1, a height of the convex rib 341 is denoted by H2, a height of the concave portion 111 of the first support member 11 is denoted by H, and a depth of the connecting groove 222' is denoted by H3. The above H1, H2, H3 and H meet a formula as follows: $H1+H2 \leq H$, and $(H-H1-H2)<H3$. Such that, the convex rib 341 can be clamped into the concave portion 111 and the bracket 20 can be prevented from separating from the concave portion 111 of the support member 10.

An elastic connecting portion 35 is disposed between the body 31 and the clamping portion 34. The elastic connecting portion 35 bends to form a shrapnel-like structure with certain elasticity. Specifically, the elastic connecting portion 35 can approximately be in a "V" shape. The elastic connecting portion 35 is configured to connect the body 31 and the clamping portion 34, and provide a certain elastic force and a movement space for the clamping portion 34. When the clamping portion 34 needs to release the clamping of the support member 10, an external force can act on the clamping portion 34 and cause the elastic connecting portion 35 to deform itself, resulting in the clamping portion 34 moving away from the support member 10 until the clamping portion 34 separates from the concave portion 111. After the clamping portion 34 is unclamped to the support member 10, the body 31 can rotate again by the rotating shaft 32, so that the storage shelving member 201 can be removed from the first accommodating groove 23.

As shown in FIG. 5 and FIG. 7, in order to facilitate the clamping portion 34 to be clamped to the support member 10 or to release the clamping state between them, the clamping portion 34 extends away from the support member 10 and forms a first pressing portion 36. The first pressing portion 36 can provide an external force and drive the clamping portion 34 to move. When the limiting member 30 is clamped to the support portion 10, the first pressing portion 36 is pressed to overcome the elastic force of the elastic connecting portion 35 and drives the clamping portion 34 to move towards the support member 10, so that the convex rib 341 of the clamping portion 34 extends into the concave portion 111. At this time, the clamping portion 34 is clamped to the support member 10. When the clamping state between the clamping portion 34 and the support member 10 needs to be released, the first pressing portion 36 is pressed to overcome the elastic force of the elastic connecting portion 35 and drives the clamping portion 34 to move away from the support member 10, resulting in the convex rib 341 separating from the concave portion 111, so as to release the clamping state between the clamping portion 34 and the support member 10.

As shown in FIG. 6 and FIG. 7, a first gasket 40 is disposed at a connection between the cantilever portion 21 and the mounting portion 22. In normal cases, after a mounting of the bracket 20 and the first support member 11, the position of the bracket 20 and the mounting plate 221 is the most vulnerable and prone to break in the process of bearing load. Therefore, in order to avoid the breaking of the bracket 20 and further improve a load capacity of the bracket 20, the first gasket 40 is further located on a local part of the bracket 20. The first gasket 40 is disposed at a connection between the support plate 211 and the mounting plate 221, and prevents collision with the connection groove 222'. The first gasket 40 is configured to improve a connecting strength between the support plate 211 and the mounting plate 221. The first gasket 40 is fixed on a position where the support plate 211 is connected with the mounting plate 221, and the first gasket 40 is overlapped with the mounting plate 221. The overlapping part of the first gasket 40 and the mounting plate 221 is matched with the mounting plate 221 so that the mounting plate 221 connected with the first gasket 40 can extend into the concave portion 111. When the mounting plate 221 fixed with the first gasket 40 extends into the concave portion 111 of the support member 10, strength of the mounting plate 221 is improved to ensure that there is sufficient connection strength between the bracket 20 and the support member 10. If the connection strength between the bracket 20 and the support member 10 is improved by directly increasing a thickness of the bracket 20 at this time, a production cost and a weight of the bracket 20 will be increased accordingly. Adding the first gasket 40 locally not only reduces the cost, but also ensures a light weight of the bracket 20, and further improves the connection strength between the bracket 20 and the first support member 11. In addition, the first gasket 40 increases a load-bearing capacity of the bracket 20 accordingly, thus increasing an overall load-bearing capacity of the storage shelving device 200.

Furthermore, a sum of a thickness of the first gasket 40 and a thickness of the mounting portion 22 must be matched with a width of the concave portion 111, so that the bracket 20 with the first gasket 40 can be easily detached from the concave portion 111.

In an optional embodiment, the first gasket 40 is fixed to the bracket 20 by means of riveting or welding, so that the first gasket 40 can be firmly connected to the cantilever portion 21 and sufficient connection strength can be ensured between the first gasket 40 and the cantilever portion 21. Before leaving the factory, the first gasket 40 can be fixedly connected to the cantilever portion 21 and the mounting portion 22 of the bracket 20.

As shown in a local enlarged view in FIG. 6, the cantilever portion 21 of the bracket 20 is provided with a second groove 25. Specifically, an opening of the second groove 25 is away from the mounting portion 22. The second groove 25 is configured to limit a flip of the other end of the storage shelving member 201 and further prevent the assembly portion 2011 from separating from the bracket 20. Specifically, the opening of the fourth groovethe second groove 25 is disposed away from the mounting portion 22. The cantilever portion 21 is provided with a hook portion 251 located at the position of the opening of the second groove 25. The hook portion 251 is located on a rotation path of the storage shelving member 201 turning over around the limiting member 30, and configured to prevent the storage shelving member 201 from turning over. In this way, the relative position between the storage shelving member 201 and the bracket 20 is further restricted under the joint action of the limiting member 30 and the hook portion 251. Namely, the hook portion 251 and an accommodating space formed between the inner wall of the second accommodating groove 33 and the elastic connecting part 35 jointly reduce a moving distance of the assembly portion 2011 along the first direction, thus limiting a possibility of the turning over of the storage shelving member 201. Thus, a combined action of the limiting member 30 and the hook portion 251 can further prevent the storage shelving member 201 from separating from the bracket 20. Alternatively, the second groove 25 is disposed at one end of the cantilever portion 21 away from the support member 10.

Of course, the hook portion 251 can also be disposed on the bracket 20*a* shown in FIG. 4 to further prevent the overturning of the storage shelving member 201.

A mounting process of the storage shelving device 200 and the storage shelving member 201 in this embodiment will be described in detail as follows:

As shown in FIG. 5 and FIG. 6, the bracket 20 is clamped into the corresponding concave portion 111 by the mounting plate 221 with the first gasket 40. The body 31 of the limiting member 30 is rotatably connected to the two cantilever portions 21 by the rotating shaft 32, and then the assembly portion 2011 of the storage shelving member 201 is put into the second groove 25 of the cantilever portion 21 and the corresponding first accommodating groove 23. The external force acts on the first pressing portion 36, and drives the limiting member 30 to rotate around the rotating shaft 32 by the first pressing portion 36, resulting in the assembly portion 2011 accommodating in the enveloping space formed by the first accommodating groove 23 and the second accommodating groove 33. Then, it continues to drive the convex rib 341 of the clamping portion 34 to be clamped into the concave portion 111 by the first pressing portion 36. The storage shelving device 200 prevents the storage shelving member 201 from separating from the bracket 20 by the limiting member 30, so that the storage shelving device 200 can stably carry the objects.

The disassembly process of the storage shelving device 200 is contrary to the mounting process, so it will not be described here.

A Second Embodiment

Figure 8:
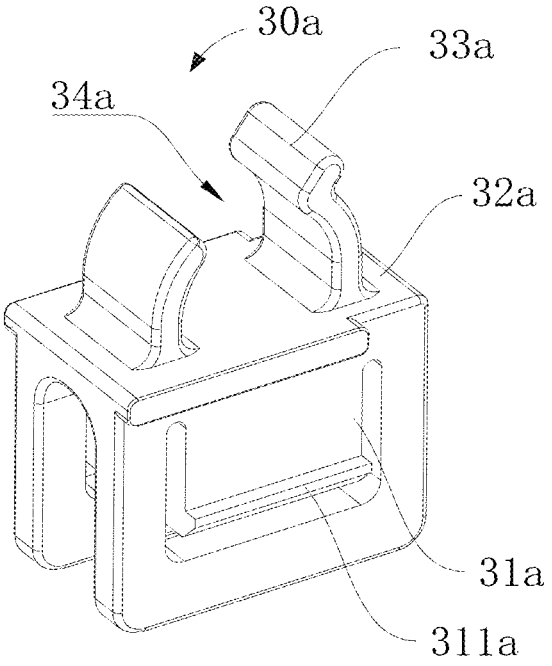
FIG. 8 is a schematic diagram of a limiting member in a second embodiment of the present disclosure.
Figure 9:
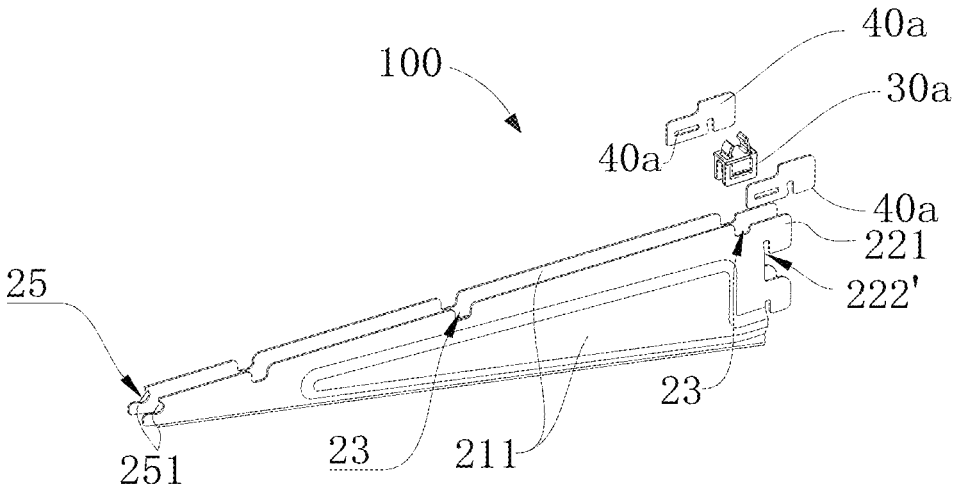
FIG. 9 is a disassembly diagram of the limiting member and other members of the bracket component of FIG. 8.
Figure 10:
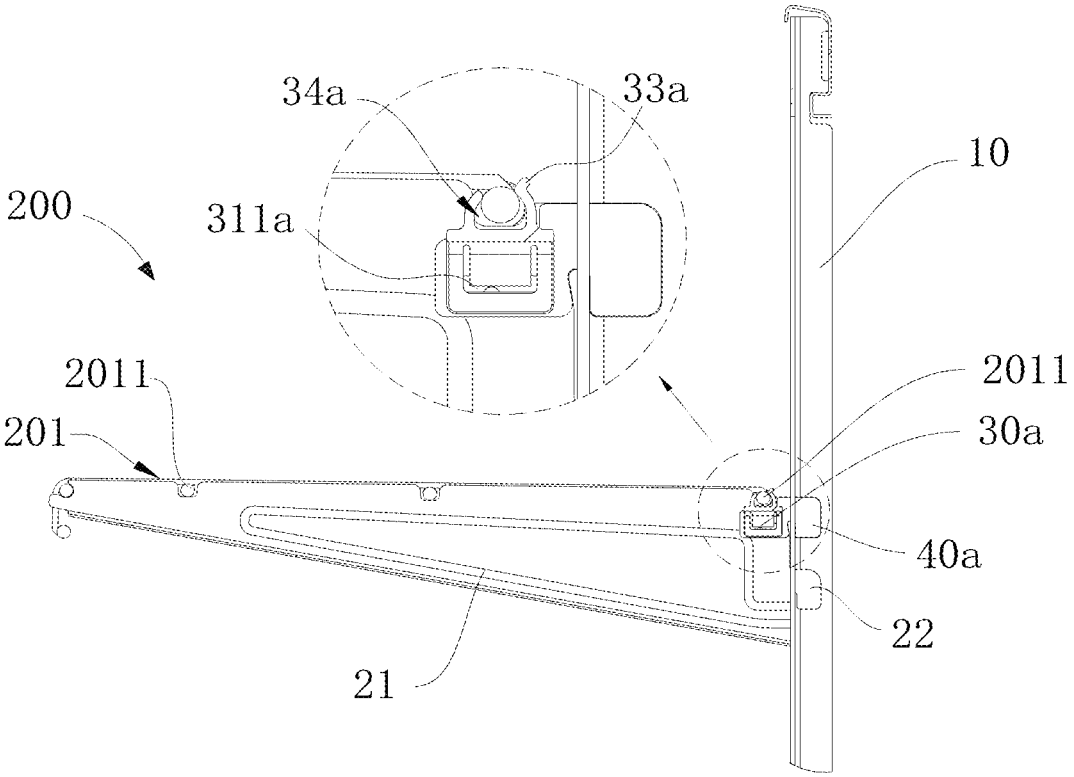
FIG. 10 is a schematic diagram of the storage shelving device with the limiting member of FIG. 8 after assembly.

FIG. 8 is a schematic diagram of a structure of the limiting member 30*a* in a second embodiment of the present disclosure. FIG. 9 is a schematic diagram of disassembly of the limiting member 30*a* and other members of the bracket component 100 of FIG. 8. FIG. 10 is a schematic diagram of a structure of the storage shelving device 200 with the limiting member 30*a* of FIG. 8 after assembly.

As shown in FIG. 8, the limiting member 30*a* includes two buckling portions 31*a* opposite to each other on two sides and a conjunction portion 32*a* between the two buckling portions 31*a*. The buckling portions 31*a* are configured to be clamped to the cantilever portion 21, and the conjunction portion 32*a* is configured to connect the two buckling portion 31*a*. The limiting member 30*a* is elastically clamped to the cantilever portion 21 of the bracket 20 by the two buckling portions 31*a*. Specifically, the limiting member 30*a* is connected to the two support plates 211 by the buckling portion 31*a*.

In order to stably dispose the storage shelving member 201 on the bracket 20, the conjunction portion 32*a* of the limiting member 30*a* is fixed with a limiting plate 33*a*. The limiting plate 33*a* bends towards the assembly portion 2011 of the storage shelving member 201 and a third groove 34*a* is formed. The limiting plate 33*a* is configured to prevent the assembly portion 2011 of the storage shelving member 201 from separating from the third groove 34*a*. The third groove 34*a* is configured to accommodate the assembly portion 2011 of the storage shelving member 201. In order to prevent the storage shelving member 201 from separating from the bracket 20, the minimum size of opening of the third groove 34*a* is less than an outer diameter of the assembly portion 2011 of the storage shelving member 201. When the assembly portion 2011 of the storage shelving member 201 is placed in the third groove 34*a* of the limiting member 30*a*, an external force is needed to drive the limiting plate 33*a* to produce a certain deformation before the assembly portion 2011 of the storage shelving member 201 can be clamped into the third groove 34*a*.

As shown in FIG. 8, a bulge 311*a* is disposed outside the buckling portion 31*a*. The periphery of the bulge 311*a* is provided with a hollow structure (unlabeled). The hollow structure can make the position of bulge 311*a* form a suspended end, so that the bulge 311*a* can be easily connected to the cantilever portion 21 of the bracket 20. The end face of the bulge 311*a* is provided with an inclined plane, which is configured to guide the bulge 311*a* into the cantilever portion 21 of the bracket or connected to the element of the cantilever portion 21.

As shown in FIG. 9 and FIG. 10, in order to strengthen the connection strength between the limiting member 30*a* and the bracket 20, a second gasket 40*a* is disposed between the cantilever portion 21 and the limiting member 30*a*. The second gasket 40*a* is fixed with the corresponding support plate 211 by welding or riveting. The second gasket 40*a* is provided with a first groove 41*a* corresponding to the bulge 311*a*. The bulge 311*a* is guided by the inclined plane at the end and extends into the first groove 41*a* so that the limiting member 30*a* is clamped to the cantilever portion 21. Before leaving the factory, the second gasket 40*a* can be fixedly connected to the cantilever portion 21 of the bracket 20.

In this embodiment, a shape of the second gasket 40*a* is approximately the same as that of the connection of the support plate 211 and the mounting plate 221, and a superposition thickness of the second gasket 40*a* and the bracket 20 is matched with a width of the concave portion 111, so that the second gasket 40*a* can be successfully clamped into the concave portion 111. In this embodiment, the function of the second gasket 40*a* is similar to that of the first gasket 40 in the first embodiment and will not be described herein.

As shown in FIG. 9, the cantilever portion 21 of the bracket 20 is provided with a second groove 25 used in conjunction with the limiting member 30*a* to further restrict the overturning of the storage shelving member 201. A structure of the second groove 25 is roughly similar to that of the first embodiment and will not be described herein.

A mounting process of the storage shelving device 200 in this embodiment is described in detail as follows.

As shown in FIG. 8 and FIG. 9, the mounting portion 22 with the second gasket 40*a* is clamped into the corresponding concave portion 111. The buckling portion 31*a* of the limiting member 30*a* is clamped into the first groove_41*a* of the corresponding second gasket 40*a*. The assembly portion 2011 of the storage shelving member 201 is placed into the second groove 25 and the multiple first accommodating grooves 23, respectively. The assembly portion 2011 of the storage shelving member 201 close to the support member 10 is pressed into the third groove 34*a*. The assembly portion 2011 on the opposite sides of the storage shelving member 201 is connected to the bracket 20 by the second groove 25 and the limiting member 30*a*.

The disassembly process of the storage shelving device 200 is contrary to the mounting process, so it will not be described here.

Third Embodiment

Figure 11:
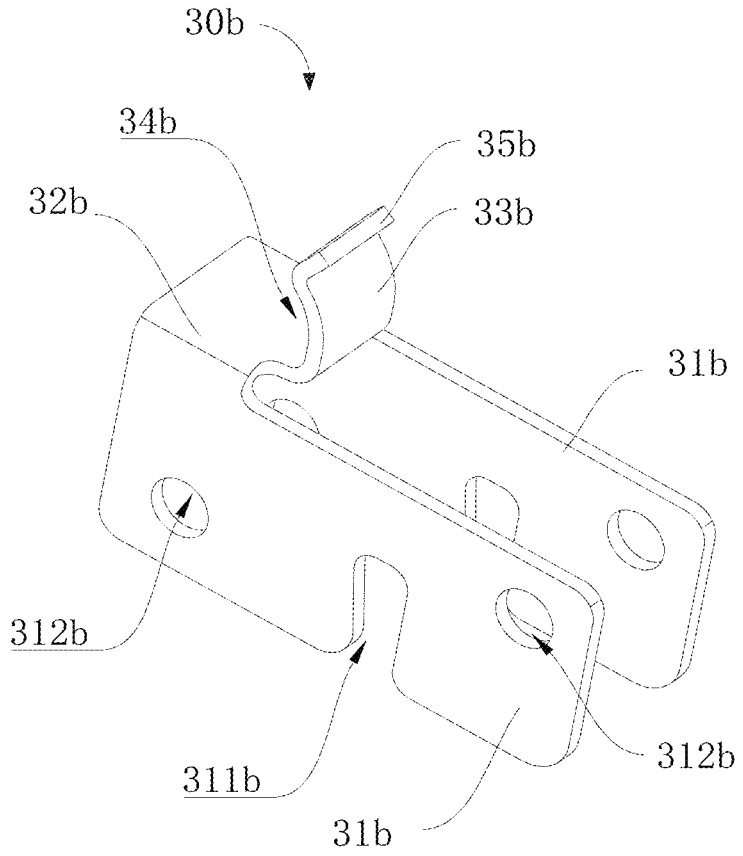
FIG. 11 is a schematic diagram of a limiting member in a third embodiment of the present disclosure.
Figure 12:
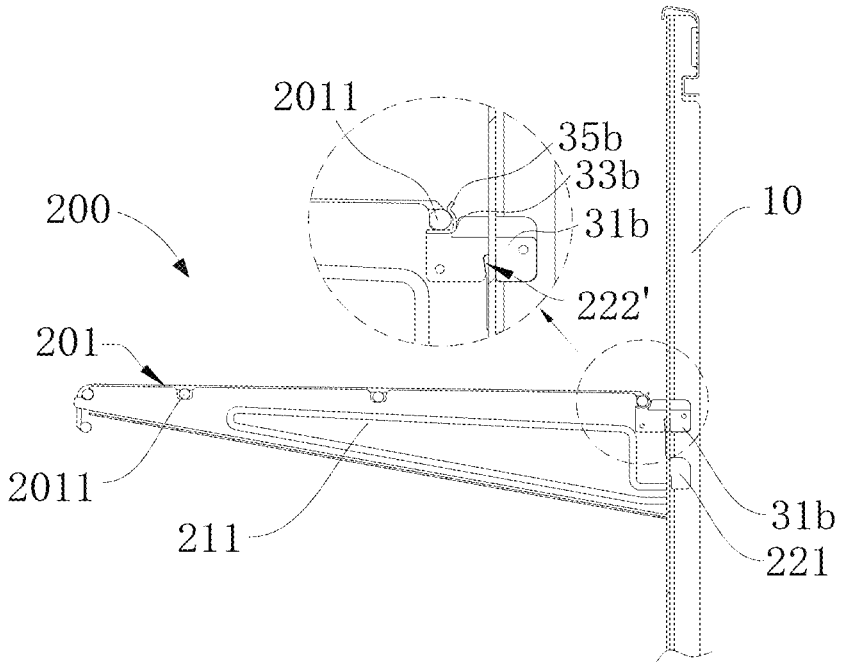
FIG. 12 is a schematic diagram of a storage shelving device with the limiting member of FIG. 11 after assembly.
Figure 13:
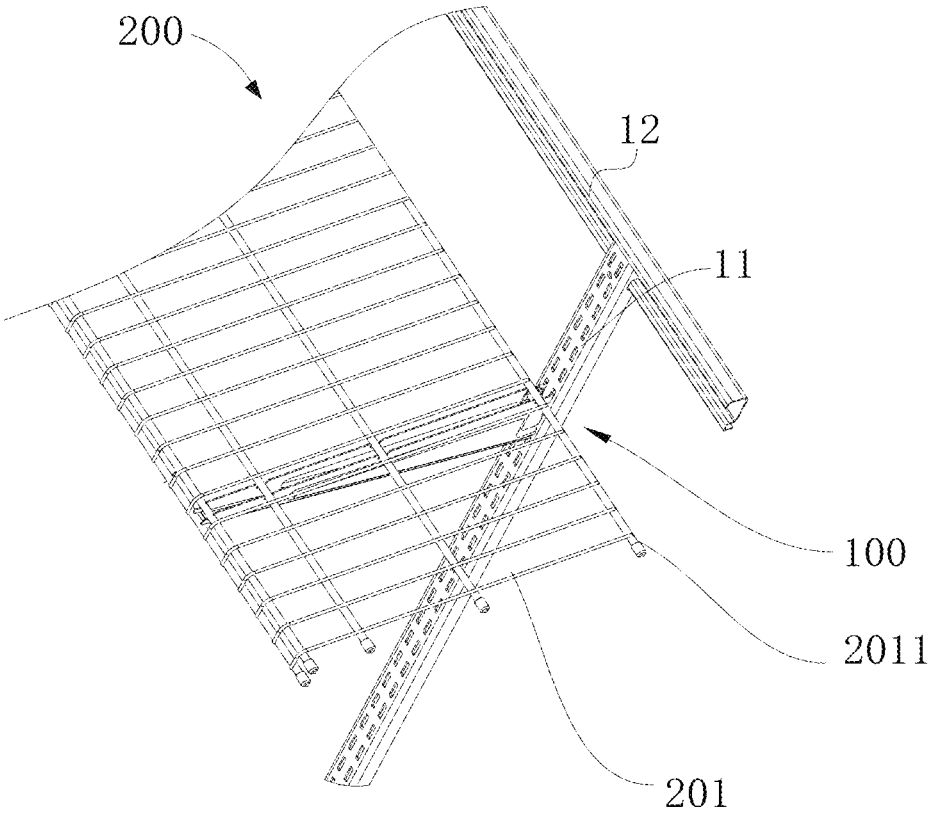
FIG. 13 is a schematic diagram of the storage shelving device of FIG. 12 in another view.

FIG. 11 is a schematic diagram of a structure of the limiting member in a third embodiment of the present disclosure. FIG. 12 is a schematic diagram of a structure of the storage shelving device with the limiting member of FIG. 11 after assembly. FIG. 13 is a schematic diagram of a structure of the storage shelving device of FIG. 12 in another view.

The limiting portion 30*b* includes two gasket portions 31*b* and a connecting portion 32*b* between the two gasket portions 31*b*. The gasket portion 31*b* is configured to strengthen the position of a connection between the support plate 211 and the mounting plate 221, and is fixed on the connection between the support plate 211 and the mounting plate 221. The connecting portion 32*b* is configured to connect two gasket portions 31*b* and realize the limiting for the storage shelving member 201. The gasket portion 31*b* acts in part the same way as the first gasket 40 in the first embodiment and the second gasket 40*a* in the second embodiment, and can also be configured to fix the connecting portion 32*b* to the bracket 20.

As shown in FIG. 11, the gasket portion 31*b* is approximately in a shape of a square sheet, and a mounting groove 311*b* is disposed in the middle of the gasket portion 31*b* and clamped into the concave portion 111. When the gasket portion 31*b* is fixed on the connection between the support plate 211 and the mounting plate 221, the mounting groove 311*b* and the connection groove 222' of the bracket 20 are overlapped with each other, so that the gasket portion 31*b* can be clamped into the concave portion 111 together with the mounting plate 221.

Alternatively, the gasket portion 31*b* is fixedly connected to the cantilever portion 21 by welding or riveting. Of course, the gasket portion 31*b* can also be provided with a first hole 312*b*, and the gasket portion 31*b* is fixed on the connection between the support plate 211 and the mounting plate 221 by riveting and other ways.

As shown in FIG. 11 and FIG. 12, a part of the connecting portion 32*b* folds towards the storage shelving member 201 and forms a limiting portion 33*b*. A fourth groove 34*b* is formed between the limiting portion 33*b* and the connection portion 32*b*. The fourth groove 34*b* is matched with the first accommodating groove 23, and configured to accommodate the assembly portion 2011 of the storage shelving member 201. The smallest opening of the fourth groove 34*b* is in the same size as the assembly portion 2011 of the storage shelving member 201. The assembly portion placed in the fourth groove 34*b* can be prevented from pulling out from the opening of the fourth groove 34*b* by the limiting portion 33*b*.

A part of the limiting portion 33*b* folds away from the storage shelving member 201 to form a second pressing portion 35*b*. The second pressing portion 35*b* is configured for external force application and driving the limiting portion 33*b* to move. In this way, the second pressing portion 35*b* can play a guiding role and facilitate the user to press the assembly portion 2011 of the storage shelving member 201 into the fourth groove 34*b*. It is also convenient for the user to apply force to the second pressing portion 35*b* to release the clamping between the limiting portion 30*b* and the assembly portion 2011 of the storage shelving member 201.

In this embodiment, a disposing mode of the bracket 20 is substantially the same as that of the first embodiment and the second embodiment, anda second groove 25 and the corresponding hook portion 251 used in conjunction with the limiting portion 30*b* are provided. The structure of the second groove 25 is substantially similar to that of the first embodiment and the second embodiment and will not be described herein.

The mounting process of the storage shelving device 200 and the storage shelving member 201 in this embodiment is substantially the same as that of the second embodiment, except that the limiting member 30*b* is fixed with the bracket 20 directly by the gasket portion 31*b*.

Figure 14:
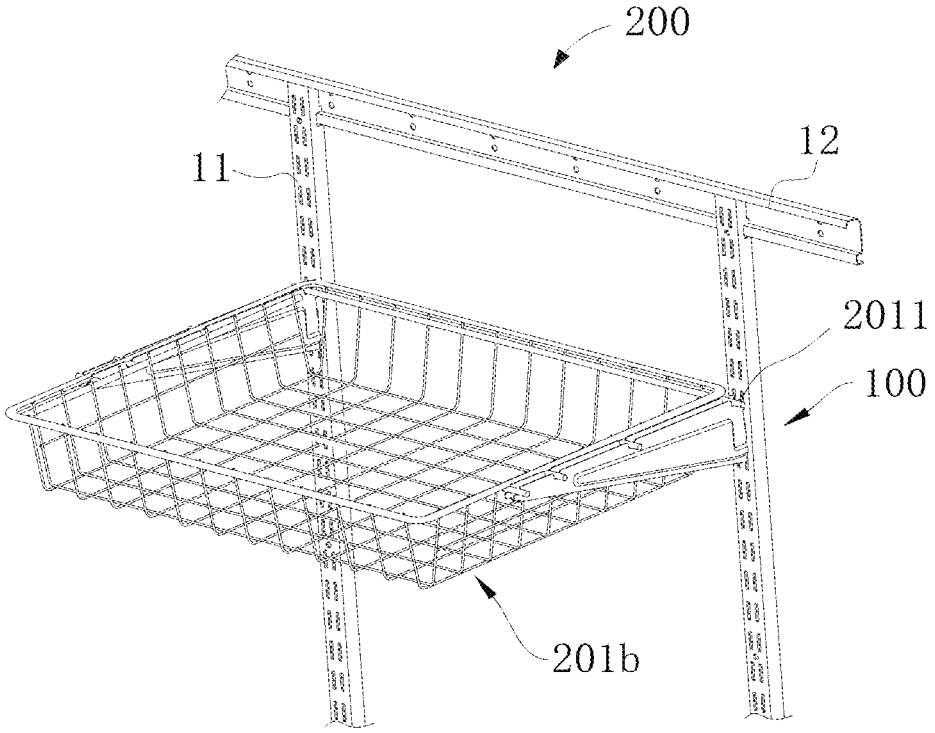
FIG. 14 is a schematic diagram of a bracket component and a storage shelving member after assembly in another embodiment of the present disclosure.

FIG. 14 is a schematic diagram of a structure of the bracket component and the storage shelving member after assembly in another embodiment of the present disclosure. The storage shelving member 201 can approximately be a flat frame body formed by overlapping multiple rods as shown in FIG. 13. The storage shelving member 201*b* can also be a frame-shaped frame 201*b* with concave inlet as shown in FIG. 14. Of course, in other embodiments, the storage shelving member 201 is in the form of a mesh structure with a mesh, etc., and the present disclosure is not restricted. The storage shelving member 201 (or 201*b*) includes the above assembly portion 2011. In the above three embodiments, the storage shelving member can be either one of the structures of storage shelving member 201 (or 201*b*) as shown in FIG. 13 or FIG. 14, and can be replaced according to requirements.

In the above three examples, the overall structure of the bracket 20 is roughly the same, and the first accommodating groove 23 of the bracket 20 is disposed according to the actual structure and position of the limiting member 30 (30*a* or 30*b*), so that the bracket 20 can be used together with the limiting member 30 (30*a* or 30*b*). It is understood that the brackets in the above three embodiments can also be the structure of the bracket 20*a*.

The fixing between the bracket and the gasket 40 (or 40*a*) or the fixing between the bracket and the gasket portion 31*b* is usually fixed at the factory. Of course, the gasket 40 (or 40*a*) or the gasket portion 31*b* can also be welded, riveted and connected to the bracket before use.

In an embodiment, a storage shelving device is provided. The storage shelving member is not easy to separate from the bracket component by disposing the limiting member, so as to avoid the hidden danger caused by the storage shelving device accordingly.

It should be noted that the above three embodiments represent only a few typical examples of the present disclosure and are not to be construed as limiting the scope of the present disclosure and that other embodiments through simple substitution or distortion are covered by the present disclosure.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A storage shelving device, comprising a storage shelving member, a bracket, a limiting member and a support member, wherein the bracket is detachably disposed in a preset mounting position, and the limiting member mounted on the bracket matches with the storage shelving member and is configured to prevent the storage shelving member from separating from the bracket;

the bracket comprises a cantilever portion configured to support the storage shelving member and disposed in the preset mounting position;

the preset mounting position is located on the support member, and the limiting member is rotatably connected to the cantilever portion and able to buckle at least a part of the storage shelving member to the cantilever portion and abut against the support member during rotation;

the support member is provided with a concave portion configured to clamp the bracket, and the limiting member comprises a clamping portion which protrudes towards the support member and is able to be clamped into the concave portion.

2. The storage shelving device of claim 1, wherein a first gasket is provided between the cantilever portion and the limiting member, and the first gasket and the cantilever portion are fixed with each other.

3. The storage shelving device of claim 1, wherein the limiting member is clamped to the cantilever portion;

a second gasket is fixedly connected between the cantilever portion and the limiting member, the second gasket is provided with a first groove, the limiting member extends towards the second gasket and forms a bulge, and the bulge extends to the first groove to match with each other resulting in the limiting member being clamped to the second gasket.

4. The storage shelving device of claim 1, wherein the limiting member is fixedly connected to the cantilever portion;

the limiting member comprises two gasket portions disposed opposite to each other and a connecting portion between the two gasket portions and configured to connect the two gasket portions, and the limiting member is fixed with the cantilever portion by the two gasket portions.

5. The storage shelving device of claim 4, wherein the two gasket portions are fixed to the cantilever portion.

6. The storage shelving device of claim 4, wherein a part of the connecting portion folds towards the storage shelving member and forms a limiting portion, a second groove is formed between the limiting portion and the connecting portion, and at least a part of the storage shelving member is accommodated in the second groove to prevent the storage shelving member from separating from the bracket.

7. The storage shelving device of claim 1, wherein the bracket is provided with a second groove, an opening of the second groove is provided with a hook portion, and the hook portion is located on a path of overturning of the storage shelving member around the limiting portion, resulting in preventing the storage shelving member from overturning;

the second groove is disposed at one end of the bracket far away from the preset mounting position.

8. The storage shelving device of claim 1, wherein the bracket is fixed in the preset mounting position by a fastening member;

the bracket further comprises a bracket connecting portion, and the bracket connecting portion is disposed on the cantilever portion and fixed in the preset mounting position by the fastening member.

9. A bracket component configured to support a storage shelving member, comprising a bracket, a limiting member and a support member provided with a concave portion, wherein the bracket is detachably disposed in a preset mounting position, and the limiting member mounted on the bracket matches with the storage shelving member and is configured to prevent the storage shelving member from separating from the bracket;

the bracket comprises a cantilever portion; the bracket is mounted on the support member by the concave portion, the limiting member comprises a rotating shaft and a clamping portion connected with each other, the limiting member is rotatably connected to the cantilever portion by the rotating shaft, and the clamping portion extends into and is clamped to the concave portion to limit a rotation of the limiting member.

10. The bracket component of claim 9, wherein the clamping portion comprises a convex rib, which extends into and is clamped to the concave portion.

11. The bracket component of claim 9, wherein the limiting member further comprises an elastic connecting portion between the rotating shaft and the clamping portion, configured to connect the rotating shaft and the clamping portion and provide an elastic force and an activity space for the clamping portion.

12. The bracket component of claim 9, wherein the clamping portion extends away from the support member and forms a first pressing portion, and the first pressing portion is configured to drive the clamping portion to move away from the concave portion and release clamping between the clamping portion and the support member.

13. The bracket component of claim 9, wherein the limiting member comprises two buckling portions disposed opposite to each other and a conjunction portion between the two buckling portions and configured to connect the two buckling portions, and the two buckling portions are respectively buckled to the cantilever portion;

the conjunction portion is provided with a limiting plate, the limiting plate bends towards the storage shelving member and forms a third groove, and at least a part of the storage shelving member is accommodated in the third groove.

14. The bracket component of claim 9, wherein the limiting member comprises two gasket portions disposed opposite to each other and a connecting portion between the two gasket portions and configured to connect the two gasket portions, and the two gasket portions are respectively fixed to the cantilever portion.

15. The bracket component of claim 14, wherein a part of the connecting portion folds towards the storage shelving member and forms a limiting portion, a fourth groove is formed between the limiting portion and the connecting portion, and at least a part of the storage shelving member is accommodated in the fourth groove;

the limiting portion is provided with a second pressing portion, and the second pressing portion folds away from the fourth groove and is configured to drive the limiting portion to release clamping between the limiting portion and the storage shelving member.

* * * * *